US006608302B2

(12) United States Patent
Smith et al.

(10) Patent No.: US 6,608,302 B2
(45) Date of Patent: Aug. 19, 2003

(54) METHOD FOR CALIBRATING A FOURIER TRANSFORM ION CYCLOTRON RESONANCE MASS SPECTROMETER

(76) Inventors: Richard D. Smith, 402 Scot St., Richland, WA (US) 99352; Christophe D. Masselon, 9202 W. Gage Blvd. #P103, Kennewick, WA (US) 99336; Aleksey Tolmachev, 915 McMurray St., Richland, WA (US) 99352

( * ) Notice: Subject to any disclaimer, the term of this patent is extended or adjusted under 35 U.S.C. 154(b) by 232 days.

(21) Appl. No.: 09/870,577

(22) Filed: May 30, 2001

(65) Prior Publication Data

US 2003/0042414 A1 Mar. 6, 2003

(51) Int. Cl.[7] ..... H01J 49/00
(52) U.S. Cl. ..... 250/252.1
(58) Field of Search ..... 250/282, 252.1

(56) References Cited

U.S. PATENT DOCUMENTS 4,500,782 A * 2/1985 Allemann et al. ..... 250/252.1
4,933,547 A * 6/1990 Cody, Jr. ..... 250/282
5,274,233 A * 12/1993 Kelley ..... 250/282
6,436,640 B1 * 8/2002 Simmons et al. ..... 435/6
6,498,340 B2 * 12/2002 Anderson et al. ..... 250/252.1

* cited by examiner

*Primary Examiner*—Jack Berman
*Assistant Examiner*—Johnnie L Smith, II
(74) *Attorney, Agent, or Firm*—Stephen R. May; Douglas E. McKinley, Jr.

(57) ABSTRACT

A method for improving the calibration of a Fourier transform ion cyclotron resonance mass spectrometer wherein the frequency spectrum of a sample has been measured and the frequency (f) and intensity (I) of at least three species having known mass to charge (m/z) ratios and one specie having an unknown (m/z) ratio have been identified. The method uses the known (m/z) ratios, frequencies, and intensities at least three species to calculate coefficients A, B, and C, wherein the mass to charge ratio of a least one of the three species $(m/z)_i$ is equal to $$\frac{A}{f_i} + \frac{B}{f_i^2} + \frac{C \cdot G(I_i)}{f_i^Q}$$

wherein $f_i$ is the detected frequency of the specie, $G(I_i)$ is a predetermined function of the intensity of the species, and Q is a predetermined exponent. Using the calculated values for A, B, and C, the mass to charge ratio of the unknown specie $(m/z)_{ii}$ is calculated as the sum of $$\frac{A}{f_{ii}} + \frac{B}{f_{ii}^2} + \frac{C \cdot G(I_{ii})}{f_{ii}^Q}$$

wherein $f_{ii}$ is the measured frequency of the unknown specie, and $(I_{ii})$ is the measured intensity of the unknown specie.

17 Claims, 7 Drawing Sheets

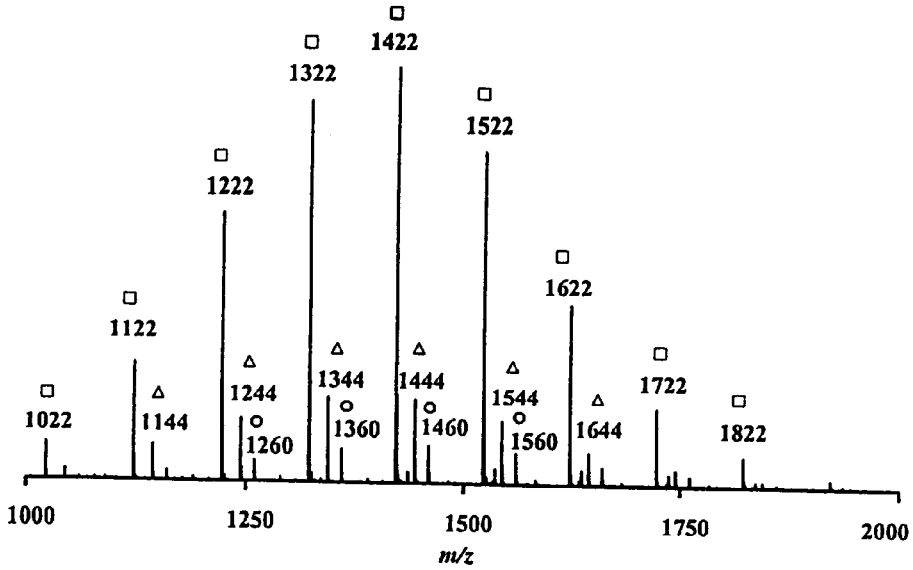
Figure 2.a
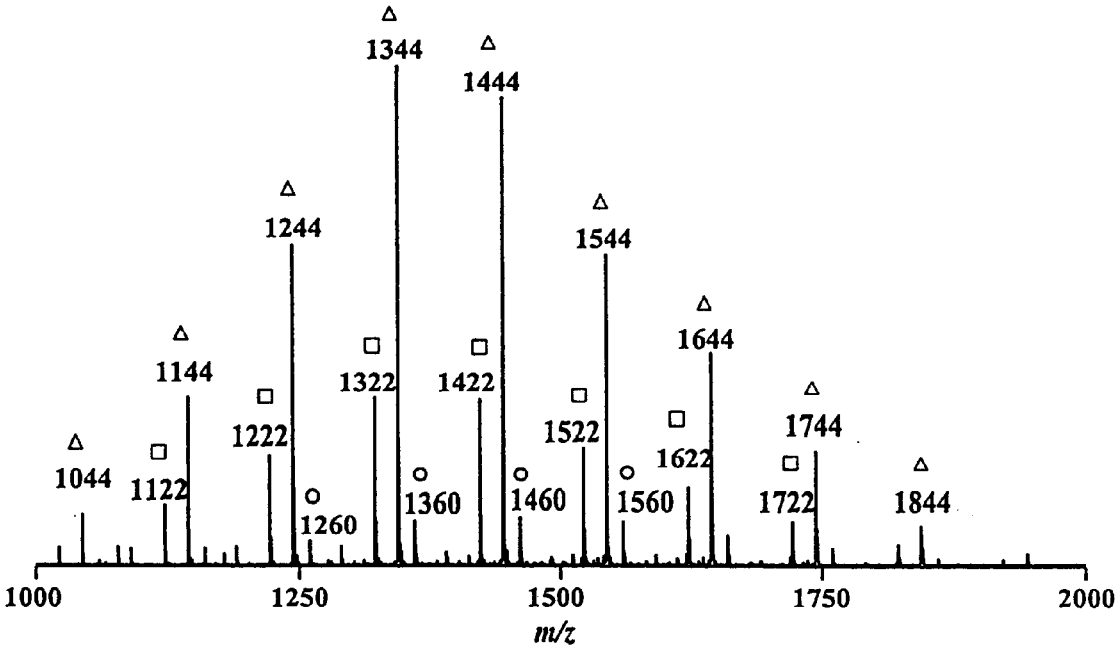
Figure 2.b

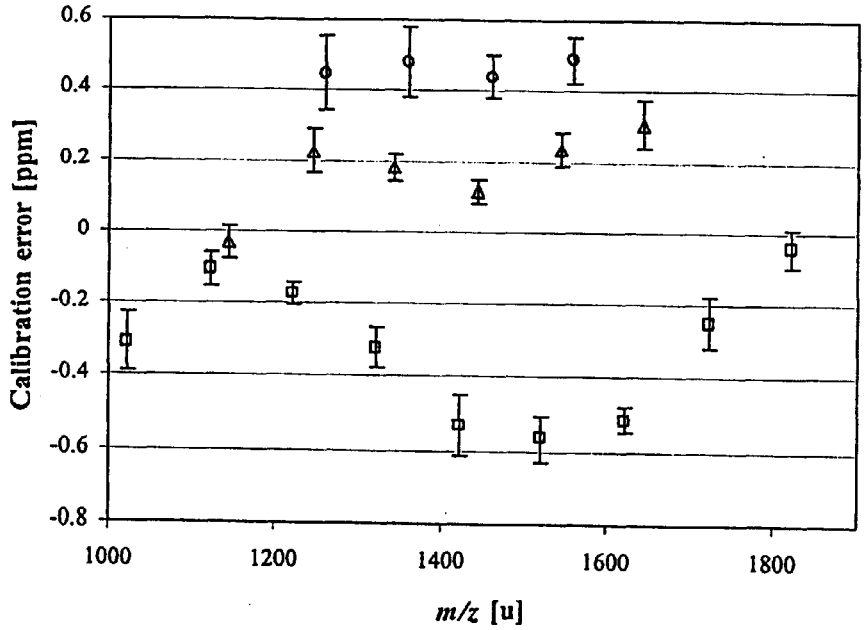
Figure 5.a
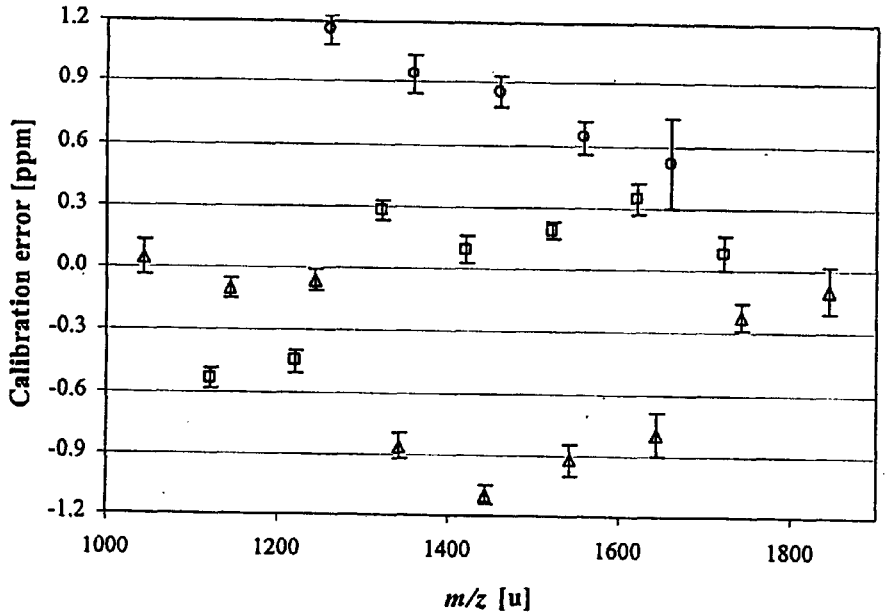
Figure 5.b

METHOD FOR CALIBRATING A FOURIER TRANSFORM ION CYCLOTRON RESONANCE MASS SPECTROMETER

This invention was made with Government support under Contract DE-AC0676RLO1830 awarded by the U.S. Department of Energy. The Government has certain rights in the invention.

FIELD OF THE INVENTION

The present invention is a method for improving the calibration of a Fourier transform ion cyclotron resonance mass spectrometer wherein the frequency spectrum of a sample has been measured and the frequency (f) and intensity (I) of at least three species having known mass to charge (m/z) ratios and one specie having an unknown (m/z) ratio have been identified. More specifically, the method uses known (m/z) ratios, frequencies, and intensities of at least three species to calculate coefficients, A, B, and C, wherein the mass to charge ratio of at least one of the three species $(m/z)_i$ is equal to $$\frac{A}{f_i}+\frac{B}{f_i^2}+\frac{C\cdot G(I_i)}{f_i^Q}$$

wherein $f_i$ is the detected frequency of the specie, $G(I_i)$ is a predetermined function of the intensity of the specie, and Q is a predetermined exponent. Using the calculated values A, B, and C, the mass to charge ratio of the unknown specie $(m/z)_{ii}$ is calculated as the sum of $$\frac{A}{f_{ii}}+\frac{B}{f_{ii}^2}+\frac{C\cdot G(I_{ii})}{f_{ii}^Q}$$

wherein $f_{ii}$ is the measured frequency of the unknown specie, and $(I_{ii})$ is the measured intensity of the unknown specie.

BACKGROUND OF THE INVENTION

For human understanding of physical, biological, and chemical systems to progress, a need for ever greater accuracy in measuring species becomes a limiting factor for accurate insight into the operation of these systems. For example, with the increased availability of genomic databases, protein identification is now substantially based on searching an appropriate database with physico-chemical data obtained for that protein. Very often, mass spectrometric data from tandem mass spectrometry (MS/MS) experiments using peptides from protein digests are employed. One of the aspects of mass spectrometry, which is often viewed as the key to successful protein identification, is mass measurement accuracy (MMA). Increased mass accuracy allows the number of potential masses in a database to be reduced, and sufficiently high MMA may make a peptide unique within the context of a specific proteome.

Fourier transform ion cyclotron resonance (FTICR) mass spectrometry currently provides the best achievable mass accuracy. However, the mass accuracy in an FTICR experiment typically depends on the number of ions used for the measurement. When online separations are used, the analyte ion production rates vary widely, and the ion population in the trap cannot be easily or precisely controlled. Although mass accuracy in the sub-ppm level has been reported with internal calibration, external calibration methods currently known in the art typically don't provide accuracies better than several ppm, particularly when the ion population for the measurement differs significantly from the ion population used for the calibration. In FTICR, the highest MMA have been obtained with small ion populations, often with the use of summation (or signal averaging) of many spectra, and of internal calibrants. However, if one desires a large dynamic range, large trapped ion populations are desired, which irrevocably causes relatively large space charge induced frequency shifts, and poorer MMA.

The widely varying ion populations that result from online separation constitute the greatest challenge. The difficulties for large ion populations in FTICR arise due to Coulomb mediated interactions between the different ions present in the cell (and their interactions with their image charge on the detection electrodes), which cause variations in measured frequencies. It has recently been demonstrated in Bruce, J. E.; Anderson, G. A.; Brands, M. D.; Pasa-Tolic, L.; and Smith, R. D. *J. Am Soc Mass Spectrom* 2000, 11, 416–421 the entire contents of which are incorporated herein by this reference, that the frequency shifts induced by coulombic interactions can be compensated for by correcting the detected frequencies, so as to align the deconvoluted spectrum of multiple charge states of the same peptide or protein. This approach provides most of the advantages associated with internal calibrant without its disadvantages. This procedure has allowed a significant improvement in mass accuracy for peptides in LC/FTMS experiments, but the mass accuracy realized still plateaus at the few ppm level due to the large variations in space charge effects.

All calibration procedures for ICR have, up to now, incorporated the space charge effect as a global effect resulting only from the number of charges in the trap. However, some frequency perturbations are known to depend on the frequency spacing between ions, e.g. the "peak-coalescence" phenomenon. It is clear that the contribution of such smaller effects is obscured by the global space charge effect, and until now, little experimental evidence of "local" frequency perturbations has been reported by Huang, J. Y.; P. W. Tiedemann, Land, D. P.; McIver, R. T; Hemminger, J. C. Int. J. Mass Spectrom. Ion Proc. 1994, 134(1), 11–21, the en ire contents of which are incorporated herein by this reference. Indeed, some authors have suggested that such an effect doesn't exist Easterling, M. L.; Mize, T. H.; Amster, I. J., *Anal. Chem.* 1999, 71, 624–632.

In FTICR, the measured quantity is the effective (cyclotron) frequency of the ions, f. This frequency is then converted to an m/z value using a calibration function. The most widespread used calibration function is (1):

$$\frac{m}{z}=\frac{A}{f}+\frac{B}{f^2} \tag{1}$$

This calibration law (1) was originally derived by Gross and coworkers as reported in Ledford, E. B.; Rempel, D. L.; Gross, M. L. *Anal. Chem.* 1984, 56, 2744–2748, the entire contents of which are incorporated herein by this reference, using results as reported in Jeffries, J. B.; Barlow, S. E.; Dunn, G. H. *Int. J. Mass Spectrom. Ion Processes* 1983, 54, 169–187 and Francl, T. J.; Sherman, M. G.; Hunter, R. L.; Locke, M. J.; Bowers, W. D.; McIver, R. T. Int. *J. Mass Spectrom, Ion Processes* 1983, 54, 189–199 the entire contents of which are also incorporated herein by this reference. According to these references, the derivation of the second term, $B/f^2$, accounts for both the DC trapping field and the space charge influence. The space charge is assumed to be generated by all ion species present in the ICR cell during collection of the time domain signal. The two calibration coefficients A and B thus are theorized to account for factors important for the FTICR mass measurement, i.e. magnetic field strength, and radial components of the trapping DC electrostatic field and the space charge field. Although an additional third-order frequency term can be added to the calibration function (1), there are no quantitative reports on its importance for the improvement of calibration quality This calibration technique assumes that the space charge is generated by all ion species present in the ICR cell during collection of the time domain signal. While this "global" space charge correction has been shown to improve accuracy of the mass calibration under conditions typical for bio-molecular studies, when the ion population in the ICR cell may vary in a broad range, it still suffers from drawbacks that hinder its accuracy. For example, the concept of a "global" space charge correction assumes that only the total trapped ion charge is significant for the mass calibration and fails to account for the possibility that the coherent motion of ions having the same m/z is influenced by other m/z ions differently than by the ions themselves. Such a situation may occur, for example, when the ion cloud motion can be, to a good approximation, described in terms of its center-of-mass motion. In this case the coulombic interactions of the same m/z ions, constituting the ion cloud, will be balanced and will not produce a net effect on the center-of-mass motion of the ion cloud. Under these conditions, accurate mass measurements must account for the coulombic interactions of the same m/z ions, constituting the ion cloud, since they will be balanced and will not produce a net effect on the center-of-mass motion of the ion cloud. Thus, there remains a need for improved methods for calibrating Fourier transform ion cyclotron resonance mass spectrometers.

SUMMARY OF THE INVENTION

Accordingly, it is an object of the present invention to provide an improved method for calibrating a Fourier transform ion cyclotron resonance mass spectrometer (FTICRMS).

It is another object of the present invention to provide an improved method for calibrating a FTICRMS that accounts for the coherent motion of ions having the same m/z as being influenced by other ions having different m/z.

It is another object of the present invention to provide an improved method for calibrating a FTICRMS that accounts for the motion of ions having the same m/z as being influenced by other ions having different m/z.

These and other objects of the present invention are accomplished by the following method for improving the calibration of a FTICRMS. As is customary in the operation of FTICRMS instruments, the frequency spectrum of a sample is first measured within the FTICRMS. The frequency (f) and intensity (I) of at least three species having known mass to charge (m/z) ratios, and one specie having an unknown (m/z) ratio, are then identified. Using the known (m/z) ratios, frequencies, and intensities of the three known species, three coefficients, A, B, and C, are then calculated, wherein the mass to charge ratio of at least one of the three species $(m/z)_i$ is equal to $$\frac{A}{f_i}+\frac{B}{f_i^2}+\frac{C\cdot G(I_i)}{f_i^Q}$$

and wherein $f_i$ is the detected frequency of the known specie, $G(I_i)$ is a predetermined function of the intensity of the known specie, and Q is a predetermined exponent. A, B, and C may be calculated using any commonly known method; preferably a least squares fit or by solving three simultaneous equations. As will be readily apparent to those having skill in the art, when practicing the invention using more than three known species a corresponding number of coefficients can also be calculated, and the number of simultaneous equations solved to arrive at accurate values for those coefficients is adjusted. For example, when practicing the invention using four known species, a fourth coefficient, D, is also calculated and a fourth term using coefficient D, $$\frac{D\cdot G(I_i)}{f_i^Q}$$

is also calculated. More generally, the present invention should be understood to include up to an infinite series of terms calculated using a corresponding number of known species, each having a unique coefficient represented by the variable S, $$\frac{S\cdot G(I_i)}{f_i^Q}.$$

Accordingly, the scope of the present invention is intended to cover all such methods whereby three or more known species are utilized and three or more coefficients are calculated and the description herein describing the method as practiced with three coefficients should in no way be seen as limiting the scope of the invention.

Using the calculated values for A, B, and C, the mass to charge ratio of the unknown specie $(m/z)_{ii}$ is then calculated as the sum of $$\frac{A}{f_{ii}}+\frac{B}{f_{ii}^2}+\frac{C\cdot G(I_{ii})}{f_{ii}^Q}$$

wherein $f_{ii}$ is the measured frequency of the unknown specie, and $(I_{ii})$ is the measured intensity of the unknown specie. As will also be apparent to those having skill in the art, the entire process is preferably automated using a computer equipped with a general purpose microprocessor and software written to perform the desired calculations. More preferred is the use of the microprocessor and software that are designed as integral to, or at least interface with, microprocessor and software which are utilized to control the FTICRMS and which measure the frequency and intensity of species within the FTICRMS. In this manner, the entire process can be automated and formed as an integral function of the operation of the instrument. Those having skill in the art will recognize that a great variety of possible configurations for this computer equipment and software are possible, and while the particular algorithm selected to implement the present invention is a merely a design choice that will depend primarily on the particular instrument being modified or constructed to practice the present invention, any such modification that performs the method described herein should be considered as falling within the scope of the invention. In the most general sense, the function $G(I_i)$ may be any function that provides an accurate result. Exemplary functions include, but are not limited to $G(I_i)=I_i^P$, wherein P is greater than 0 and less than or equal to 10 and $G(I_i)=\ln I_i$. As will be apparent to those having skill in the art, when the present invention is practiced using more than three coefficients, the additional terms corresponding to the additional coefficients also have predetermined functions. These predetermined functions may be the same across the terms, or they may vary. The selection of which functions to use in each term calculated according to the present invention to achieve the best accuracy will be dependant on the specific instrument and its operating conditions, and the error introduced by that instrument and its operating conditions.

Similarly, in the most general sense, the exponent Q is an exponent selected to correspond to the selected function $G(I_i)$ to provide an accurate result. Preferably, exponent Q is selected as between 0 and 10. In a first preferred embodiment of the present invention, where three coefficients are calculated, $G(U_i)$ is selected as equal to $I_i$ and Q is selected as 2. In a second preferred embodiment, $G(I_i)$ is selected as equal to in $I_i$ and Q is selected as 3. The particular function and exponent selected may depend on a variety of factors, for example, they may depend on systemic errors that are specific to the configuration of a particular instrument. However, all such variations will have in common the use of the term which relates the coefficient C, the intensity of the frequency of the known and unknown species, and the measured intensity of the known and unknown species, to form a more accurate calibration of the instrument, and any such variations should be considered as falling within the scope of the present invention. As will be apparent to those having skill in the art, when the present invention is practiced using more than three coefficients, the additional terms corresponding to the additional coefficients also have predetermined exponents, Q. These predetermined exponents may be the same across the terms, or they may vary. In circumstances where the exponents are varied, they may vary in a geometric or linear progression. For example, if the exponent that corresponds to coefficient C is Q, in certain applications, the exponent that corresponds to coefficient D could be selected as Q+1, with the exponent that corresponds to coefficient E selected as Q+2, and so forth. The selection of which exponents to use in each term calculated according to the present invention to achieve the best accuracy will again be dependant on the specific instrument and its operating conditions, and the error introduced by that instrument and its operating conditions.

A further refinement of the present invention may be found by the addition of a term that makes the calibration procedure insensitive to the units of ion intensity. An example of this embodiment of the present invention may be illustrated by considering a calibration function having 4 terms. As previously described, in practicing this embodiment of the present invention, four calibrants, or ion species having known m/z, intensity and frequency values, are used to calculate calibration coefficients A, B, C and D. These may be calculated directly from simultaneous equations, or if more than four calibrants are available, A, B, C and D may also be calculated by means of the least square fit procedure. Either procedure results in a solution for the calibration coefficients, as set forth in the exemplary calibration function below.

$$(m/z)_i = \frac{A}{f_i} + \frac{B}{f_i^2} + \frac{C \cdot \ln(I_i)}{f_i^3} + \frac{D}{f_i^3}$$

The calibration procedure may then be made insensitive to the units of ion intensity by manipulation of the 4-th term $D/f^3$.

Multiplication of the ion intensity $I_i$ by an arbitrary scale factor S results in additional term:

$$\frac{C \cdot \ln(S \cdot I_i)}{f_i^3} = \frac{C \cdot \ln(I_i)}{f_i^3} + \frac{C \cdot \ln(S)}{f_i^3}$$

Thus, scaling $I_i$ by S is equivalent to adding C·ln(S) to the D calibration coefficient. It follows that the calibration function is automatically adjusted for any units of ion intensity.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 2. is a FTCIR mass spectrum for Ultramark showing the protonated (□) sodiated (Δ) and potassiated (○) polymer ion distributions; for (a) a sample with a low sodium concentration, and (b) a sample a higher sodium concentration.

FIG. 5. is a graph showing calibration errors obtained from a linear fit using eq. (2) vs. m/z for a SWIFT excitation to a radius 1.26 cm (Symbols as in FIG. 2). Note the repartition of the points around the calibration with the masses of protonated species always underestimated, and those of sodiated and potassiated species always overestimated (a). A reversal of this trend is observed when a higher sodium concentration is used (b) Error bars represent 95% confidence intervals based on 10 measurements.

DESCRIPTION OF THE PREFERRED EMBODIMENT(S)

Figure 1:
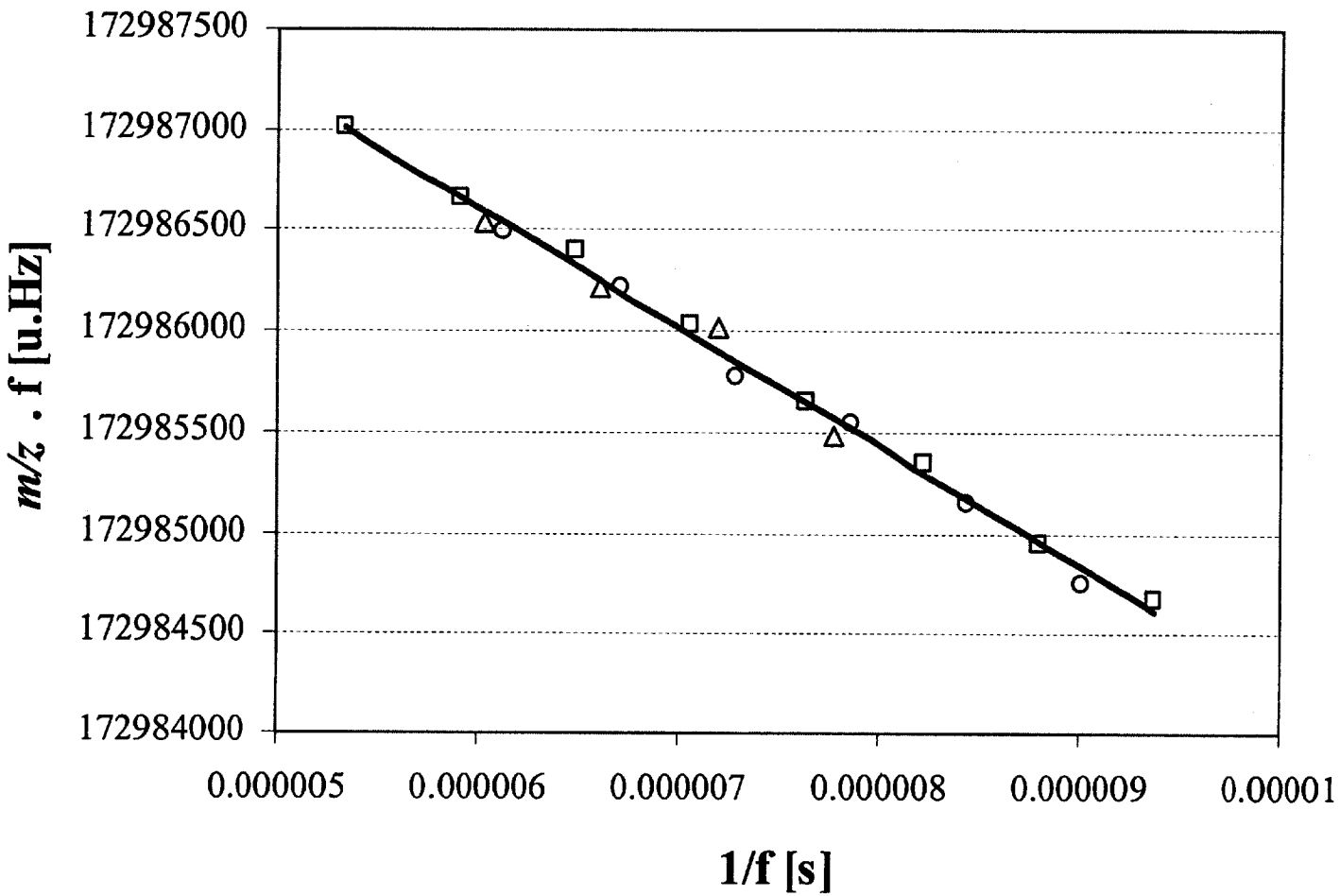
FIG. 1. is a graph m/z.f vs. inverse of frequency plot for an FTICR spectrum of an Ultramark calibration solution, showing the linear fit using calibration eq. (2). The points represent known m/z values of (□) [M+H]+ions, (Δ) [M+Na]+ions and (○) [M+K]+ions of the polymer (symbols as in FIG. 2.)

An experiment was carried out to demonstrate the efficacy of the present invention in improving the accuracy of an FTICRMS. While the experiments described herein successfully demonstrated the efficacy of the present invention in improving the accuracy of the FTCRMS instrument used in the experiments, this description should in no way be considered as limiting the scope of the present invention to either the equipment utilized in the experiments, or to the specific techniques that were utilized and which are described herein. Rather, the invention should be broadly construed to encompass all of the modifications and alternatives contemplated in the preceding summary of the invention and in the appended claims.

Perfluoro-alkylphosphazine (Ultramark 1621) was purchased from Thermoquest (San-Jose, Calif.) and used without further purification. The polymer was diluted in acetonitrile to a concentration of 0.002% v/v. The solution was spiked with NaOH (20 mM in $H_2O$) to produce Na adducts. K adducts arose naturally from contamination of the solution (by e.g. ambient dust).

All experiments were performed using an 11.5 tesla FTICRMS equipped with an external electrospray ion source and an elongated cylindrical open-ended cell, and which is described in detail in Udseth, H. R.; Gorshkov, M. V.; Belov, M. L.; Pasa-Tolic, L.; Bruce, J. E.; Masselon, C. D.; Harkewicz, R.; Anderson, G. A.; Smith, R. D. *Proceedings of the* 37$^{th}$ *ASMS Conference on Mass Spectrometry And Allied Topics,* Dallas, Tex. Jun. 13–17, 1999, the entire contents of which are incorporated herein by this reference. The instrument was controlled by an Odyssey (Finnigan, Madison, Wis.) data-station.

The polymer solution was introduced to the electrospray ionization (ESI) source at a rate of 0.3 $\mu$l/min using a Harvard Apparatus (Holliston, Mass.) model 22 syringe-pump. A +2 kV voltage was applied to the ESI emitter, and charged species were injected through a 500 $\mu$m diameter heated metal capillary maintained at 160° C. At the exit of the metal capillary, the ion beam was focused to the entrance of a quadrupole ion guide. The ions were accumulated for a period of 200 to 600 ms in an external storage quadrupole before transfer to the FTICR cell. After transfer, ions were cooled by a pulse of $N_2$ gas, and excited by either a chirp or a Stored Waveform Inverse Fourier Transform (SWIFT) excitation as described in Marshall, A. G.; Hendrickson, C. L.; Jackson, G. S. *Mass Spectrom. Rev.* 1998, 17, 1–35, the entire contents of which are incorporated herein by this reference. The ion signal was digitized at a 761,904 Hz acquisition frequency for 688 ms (512 Kb data points). The resulting transient was zerofilled twice before Fourier transformation and the peaks were picked in the frequency domain using a 3 points quadratic approximation. Only monoisotopic peaks with signal to noise >3 and relative intensity >5% were used to generate the calibration. Data analysis was performed using the ICR-2LS software package described in ICR2LS; Anderson, G. A.; Bruce, J. E., Eds.; Pacific Northwest National Laboratory: Richland, Wash., 1995, the entire contents of which are incorporated herein by this reference.

The first experiments were performed to study the effect of ion population on the internal calibration. Series of single spectra (no signal averaging) were recorded for different ion populations of perfluoro-alkylphosphazine (Ultramark). A typical mass spectrum of Ultramark is presented in FIG. 2*a*. It shows the molecular weight distribution of the polymer and the sodium and potassium adduction. Monoisotopic masses for the protonated, sodiated and potassiated ions of the polymer were used for calibration.

The ion population could not be easily determined experimentally (based on TIC measured from the ICR spectra), since it did not vary linearly with the accumulation time. However, the ion population did vary monotonically with the external ion accumulation time in our experiments. The total ion population in the ICR cell was thus varied by using 200, 400 and 600 ms external accumulation time.

The aim of this experiment was to analyze deviations from the calibration function (1) under conditions typical for bio-molecular FTICR mass-measurements, i.e. when the highest possible mass accuracy is desirable in a wide mass range, and for widely varying ion populations. Electrospray spectra of Ultramark solutions were used to obtain accurate mass-reference values in the mass range 1000–1800 u. To test the calibration function (1) the linearized form was used:

$$F(x) = A + B \cdot x;\ F(x) \equiv \frac{m}{z} \cdot f,\ x \equiv \frac{1}{f} \tag{2}$$

Each peak of known m/z yields a point on the F(x) plot. Using the Ultramark [M+H]+peaks together with its $Na^+$ and $K^+$ adducts, ~20 points were obtained on such a plot, as shown in FIG. 1. Deviations from the calibration function (1) were then analyzed by calculating a linear regression, which resulted in accurate A and B calibration coefficients, and also yielded the correlation coefficient, showing the quality of the linear approximation. As will be recognized by those having skill in the art, ideally, the correlation coefficient should be close to 1, and errors should be confined to the ppm level.

Figure 3:
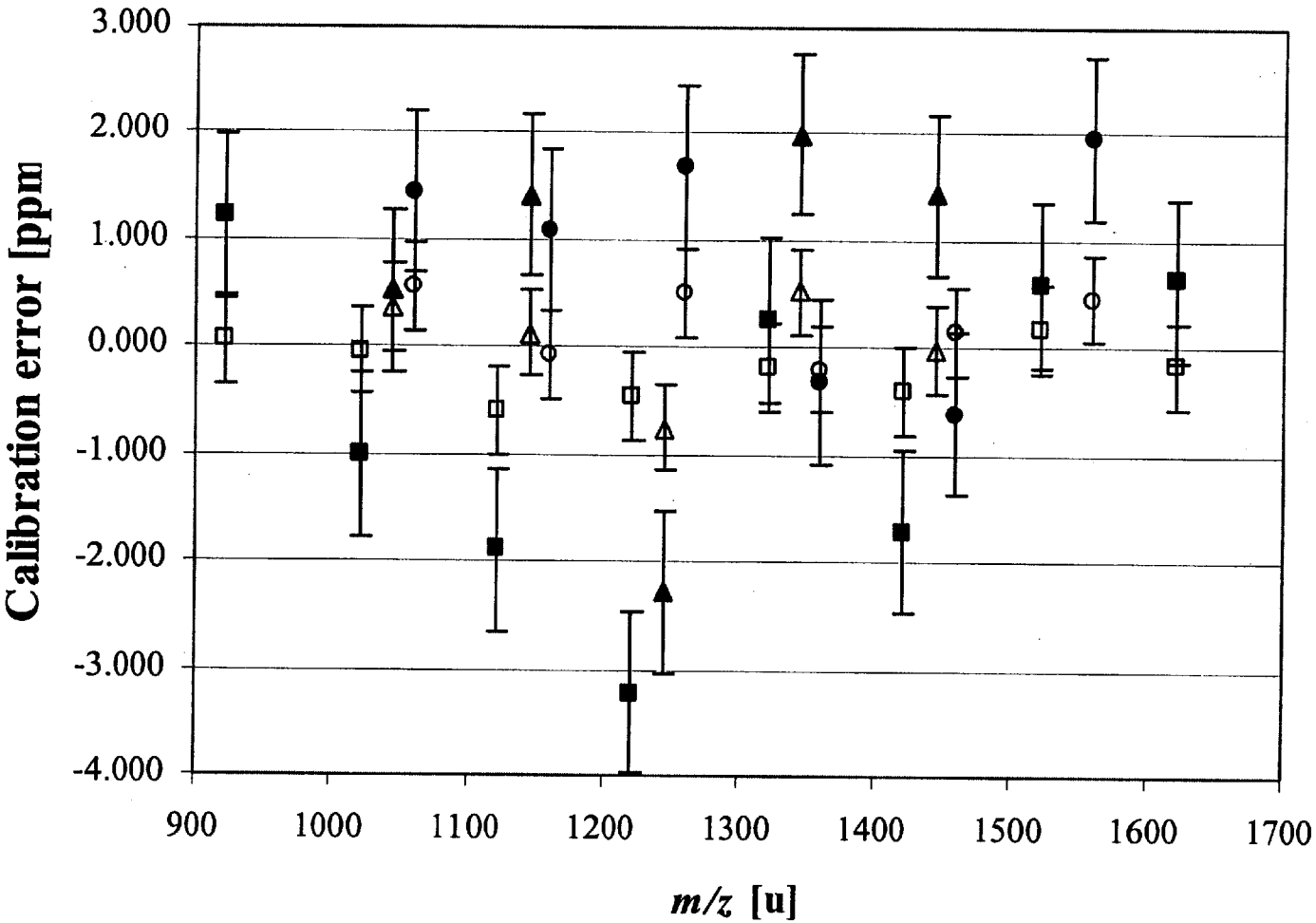
FIG. 3. is a graph showing calibration errors obtained from the linear fit from eq (2) vs m/z for external accumulation times 400 ms (open symbols) and 600 ms (filled symbols) using chirp excitation (symbols as in FIG. 2). Error bars represent 95% confidence intervals based on 10 measurements.
Figure 4:
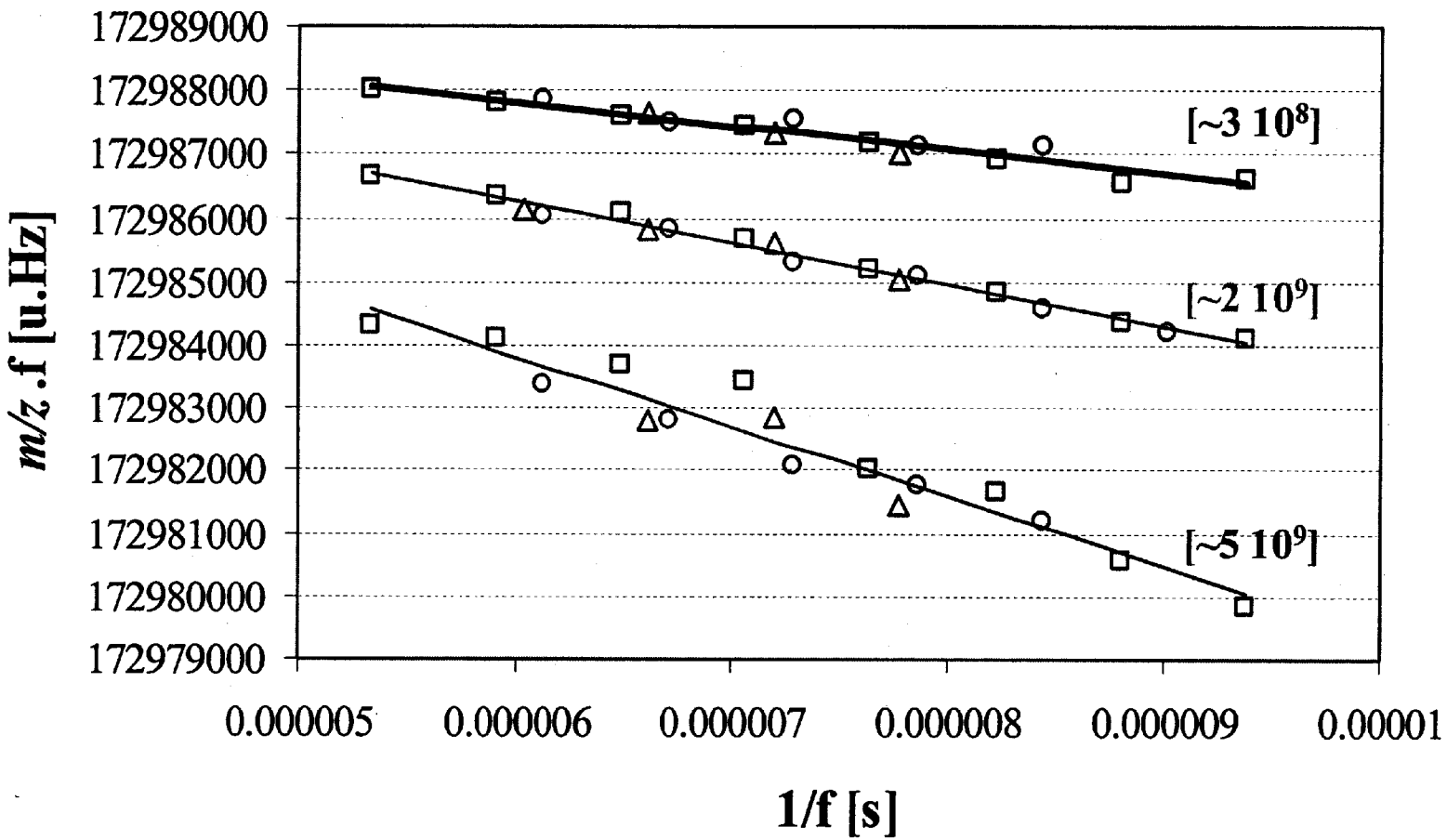
FIG. 4. is a graph showing calibrations obtained for three ion populations resulting from different external accumulation times, TIC (arbitrary units) indicated between brackets (symbols as in FIG. 2). Correlation coefficients are 0.94, 0.99, and 0.91 for the 200, 400 and 600 ms accumulation times, respectively.

By plotting the (m/z·f) vs. (1/f) graph for the series of data files obtained from those measurements, some masses were observed as systematically over- or under-corrected. FIG. 3 shows the mass errors obtained for an internal calibration of two spectra acquired at 400 ms and 600 ms accumulation respectively, the error bars indicate the 95% confidence interval for 10 measurements obtained under the same conditions. There is no obvious trend of a mass dependent deviation from linearity. FIG. 4 shows the (m/z·f) vs. (1/f) plot for three spectra taken at different accumulation times. It is evident, that a "global" space charge effect is present, thus increasing the absolute value of the slope of the plot (B coefficient). At the same time, the errors become more pronounced when the ion population in the ICR trap increases, and errors of more than 3 ppm (even using internal calibration) were obtained for the 600 ms accumulation experiment, with correlation coefficients for the calibration function decreasing to 0.90 as shown in FIG. 4. The striking fact is that while the frequencies were measured quite precisely (see error bars on FIG. 3.), the calibration correction was ineffective.

As is apparent from these measurements, either the ion population has to be carefully controlled in order to avoid large systematic errors even with internal if calibration, or improved calibration methods are required. At higher population, space charge effects cause larger mass errors, and at too low ion population, the contribution of the noise ultimately becomes limiting and degrades the mass accuracy as well as the dynamic range.

One possible origin for the systematic errors determined previously could be due to variations in excite radii for different m/z, since the chirp excite waveforms used for excitation, are known not to provide an optimally flat excitation spectrum. In order to test this hypothesis, additional experiments were performed using a stored waveform inverse Fourier transform (SWIFT) excitation, which provides a flatter excitation over the m/z range of interest.

A SWIFT excitation waveform was calculated to excite all ions in the m/z range of interest. An external accumulation of 400 ms was used for these experiments since it provided the lowest overall error in the previous measurements. The plot of the mass errors vs. m/z is shown in FIG. 5*a* for a series of 10 spectra taken in the same conditions (10 single acquisitions at a post-excite radius of ~1.26 cm). As can be seen from this plot, the use of SWIFT excitation similarly reveals systematic errors in mass measurements (which were smaller in amplitude). It is worth noting that the error bars were also smaller, due to the better controlled post-excite radius.

FIG. 5*a* also shows a clear pattern in the plot of the errors vs. m/z. The peaks in the center of the spectrum, where the abundances were greater, had larger errors than the peaks at the extremes, and their errors were consistent with the intensities when taken "locally": i.e. lower abundance ions were found to have errors skewed on one side of the calibration, and high abundance ions on the other side. This implies that the uncorrected cyclotron frequencies for higher abundance ions were too high and frequencies for low abundance ions were too low. However, the errors were not found to be highly correlated with the abundances of the individual ions: for instance, the mass of an $[M+H]^+$ ion at the edge of the distribution was better determined than an $[M+Na]^+$ in the center of the spectrum although its intensity was smaller than the latter.

Figure 6:
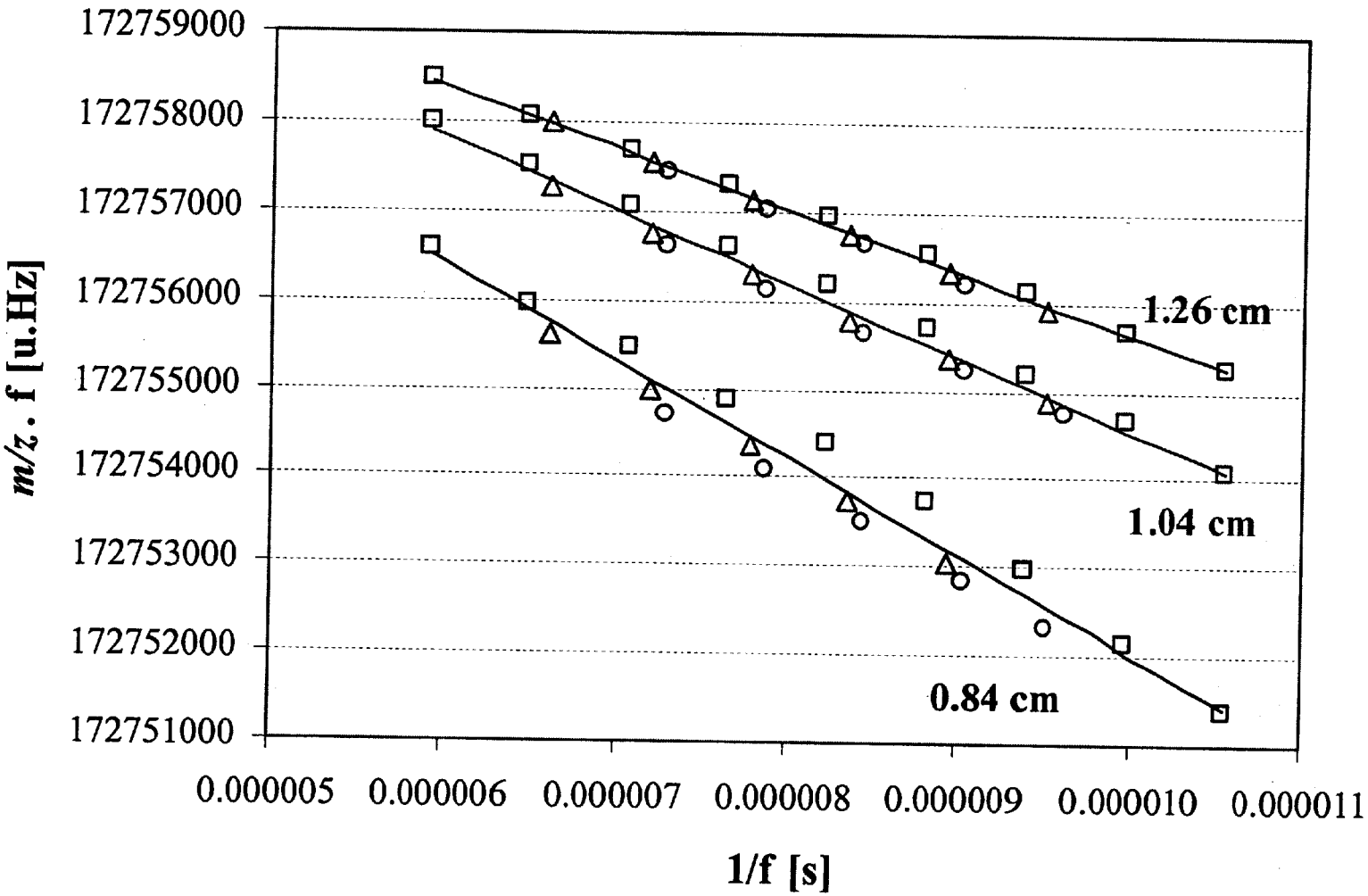
FIG. 6. is a graph showing calibrations obtained for three post-excite radii after SWIFT excitation, post-excite radii indicated between brackets (symbols as in FIG. 2).
Figure 7:
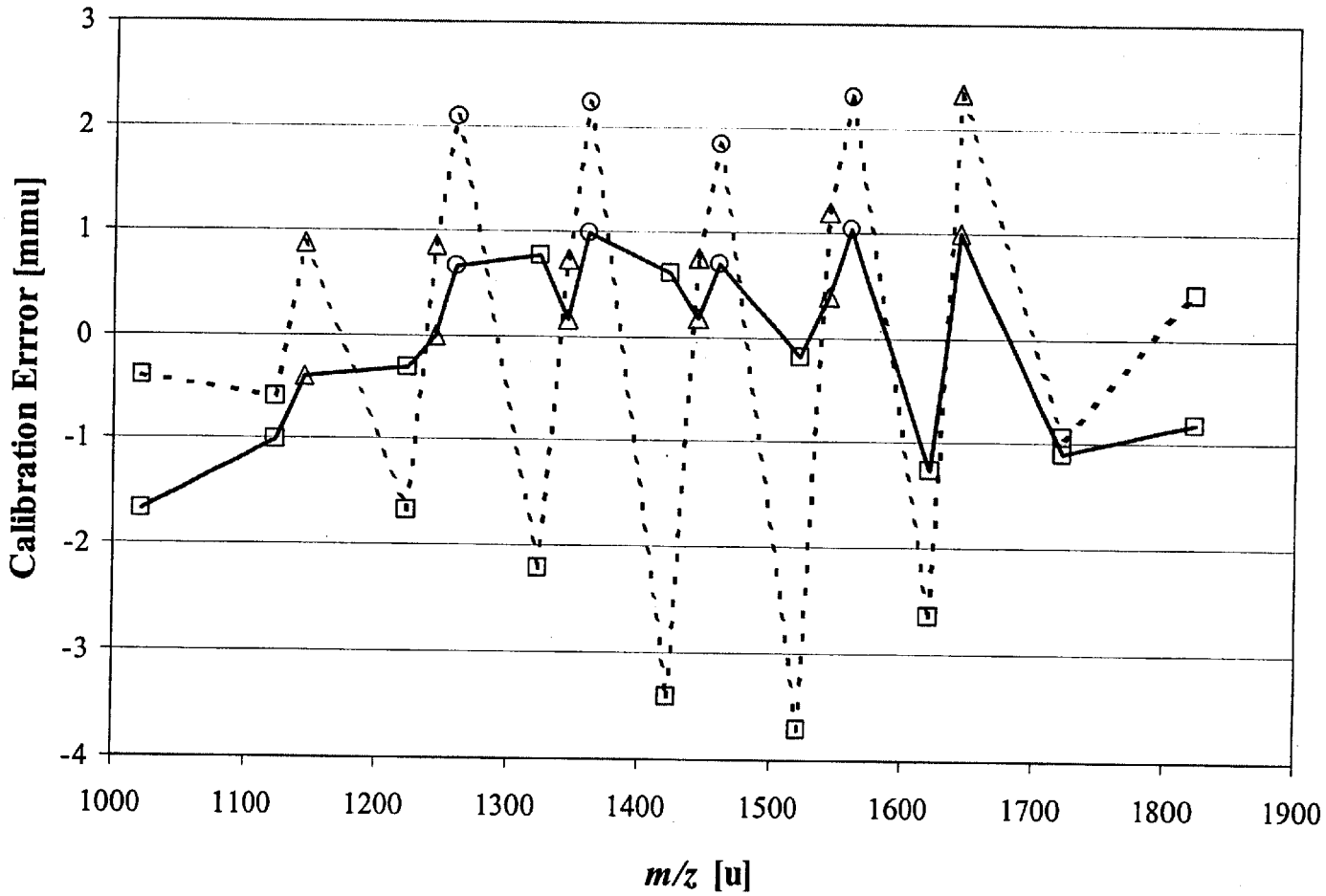
FIG. 7. is a graph showing calibration errors for the standard calibration (dashed line) function and for the calibration using eq. (5) (solid line). Summation of 10 spectra using SWIFT excitation to a 0.84 cm post-excite cyclotron radius (symbols as in FIG. 2). Lines are only present to guide the eye.

These experiments were repeated using different SWIFT excitation radii, and the systematic errors become larger for smaller excitation radii, as shown in FIG. 6. The correlation coefficient dropped from 0.98 to 0.80 for a decrease in radius from 1.26 cm to 0.84 cm.

These observations, together with the fact that those errors increased with ion abundances, suggest that the observed effects originate from Coulomb mediated interactions. The reproducible nature of the observed errors, also suggests that individual ion clouds in the ICR cell experience qualitatively different interactions with the other ion clouds.

To further investigate this issue, a sample with higher NaOH concentration resulting in a distorted distribution of ionic species was compared to the initial experiments. Analysis of the calibration errors revealed similar behavior. The most abundant ions (in this case the [M+Na] species) were primarily shifted to higher frequency relative to the calibration whereas the lower abundance species ([M+H] and [M+K]) were shifted to lower frequency (see FIG. 5*b*.) These data show that the observed frequency shifts are related to the number of ions for each species (signal intensities) and not to a specific nature of the ionic species.

The systematic behavior observed for the frequency shifts may be used to correct these shifts and to improve the mass measurement accuracy. As discussed above, the SWIFT-excite data show a correlation between peak intensities and the frequency shift magnitudes. More intense peaks have positive frequency shifts, and less intense ones reveal negative frequency shifts. In terms of measured m/z (FIG. 5*a*) all intense peaks have negative mass errors (protonated ions, squares), and lower abundance peaks have positive mass deviations from the calibration line ($Na^+$ and $K^+$ ions, triangles and circles).

These deviations from the standard calibration law may be interpreted in terms of space charge induced frequency shifts. The role of the ion space charge becomes increasingly important for FTICR/MS because both the total ion population and specific ion abundances may vary in a wide range.

These detailed measurements of the frequency shifts demonstrate that an approach considering only the total ion intensity is insufficient, and individual peak intensities must be taken into account if very high MMA is to be realized. Positive frequency shifts for more intense peaks may indicate that ion clouds having greater number of charges experience reduced space charge effect. Thus, if both ion excitation and detection of the ion cloud can be described in terms of the center-of-mass motion, the frequency shift due to the ion cloud itself must vanish, and only other m/z clouds will contribute to the space-charge induced frequency shift.

According to the original derivation, the coefficient B in the calibration function (1) can be divided into two parts, one for the magnetron motion, $B^{trap}$, and one for the space charge correction, $B_{SC}$:

$$B=B_{trap}+B_{SC};\ B_{Sc}=C\cdot I_{total};\ I_{total}=\Sigma I_i \tag{3}$$

It is assumed here, that the space-charge term is proportional to the total ion population, and can be expressed in terms of the total ion intensity of a mass spectrum $I_{total}$ multiplied by some coefficient C. Here we use a property of FTICR mass spectra: to a good approximation peak intensities ($I_i$) are proportional to the total ion charges of corresponding m/z ions. For the situation considered above, when clouds of the same m/z ions experience only "external" space-charge influence, we must subtract each peak intensity $I_i$ from $I_{total}$:

$$B_{SC}=C\cdot(I_{total}-I_i) \tag{4}$$

Here i is an index designating each separate m/z ion species as $(m/z)_i$. We can now regroup terms to separate those having the index i, arriving at a new calibration function:

$$\left(\frac{m}{z}\right)_i=\frac{A}{f}+\frac{B}{f^2}+\frac{C\cdot I_i}{f^2} \tag{5}$$

The function differs from the common calibration law (1) by the additional term $C\cdot I_i$, taking into account the individual peak intensities $I_i$. Note that the sign of the C coefficient is reversed for convenience. Those having skill in the art will recognize that the expected values of A (the magnetic field term) and C are positive, and a negative value is expected for B.

The calibration coefficients A, B and C are independent of the index i. Thus to calibrate a mass spectrum using eq. (5) at least 3 reference peaks are needed, i.e. peaks with accurately defined frequencies and intensities, and attributed to known m/z values. When more then 3 reference peaks are present, as in the case of our Ultramark spectra considered above, it is possible to use the least-squares fitting procedure (LSQ) to obtain the coefficients that give the best overall fit to the peaks used for calibration.

Such LSQ-calibration, based on the modified calibration function (5), has been applied to the Ultramark spectra discussed above. To evaluate the overall accuracy of the mass calibration an average squared mass error a, was calculated as follows:

$$\varepsilon=\sqrt{\frac{1}{N}\sum\delta m_i^2}\ ;\ \delta m_i=F(f_i,I_i)-(m/z)_i \tag{6}$$

Here N is the number of reference peaks used for the calibration; each mass error $\delta m_i$ is calculated as the difference between the calibration function $F(f_i, I_i)$, estimated using eq. (5) for the corresponding peak frequency $f_i$ and intensity $I_i$, and the accurate value $(m/z)_i$. Table 1 lists the calibration mass errors obtained for mass spectra with estimated excitation radii of 1.3 cm, 1.0 cm and 0.84 cm (see discussion above concerning the SWIFT-excite spectra).

TABLE 1

Mass measurement accuracy obtained in various conditions from the summation of 10 time-domain transient: comparison of the common calibration law eq. (1) and the modified calibration law, eq. (5)

| Excite radius | Mass range, Da | Number of Peaks [a], N | Mass error [b] $\epsilon_0$, mDa | Corrected error [c] $\epsilon$, mDa | $\epsilon_0/\epsilon$ |
|---|---|---|---|---|---|
| 1.3 cm | 0–2000 | 19 | 0.514 | 0.329 | 1.56 |
| | 1200–1700 | 14 | 0.567 | 0.200 | 2.84 |
| | 1300–1500 | 6 | 0.517 | 0.105 | 4.92 |
| 1.3 cm * | 0–2000 | 21 | 0.860 | 0.556 | 1.55 |
| | 1200–1700 | 15 | 0.991 | 0.438 | 2.26 |
| | 1300–1500 | 6 | 1.088 | 0.188 | 5.79 |
| 1.0 cm | 0–2000 | 19 | 1.240 | 0.718 | 1.73 |
| | 1200–1700 | 14 | 1.389 | 0.391 | 3.55 |
| | 1300–1500 | 6 | 1.353 | 0.202 | 6.70 |
| 0.84 cm | 0–2000 | 16 | 2.169 | 1.161 | 1.87 |
| | 1200–1700 | 12 | 2.456 | 0.856 | 2.87 |
| | 1300–1500 | 6 | 2.266 | 0.507 | 4.47 |

*Na - enriched sample, see FIG. 2b.
[a]A dynamic range of 0.05 has been used for choosing the reference peaks, i.e. only peaks of amplitude greater than 0.05 of the most abundant peak were used.
[b]Obtained using eq. (1) (see text)
[c]Obtained using eq. (5) (see text)

Three different mass ranges were considered for each spectrum. For comparison, the corresponding mass error was also calculated without correction ($\epsilon_0$.) obtained using the same procedure, with the common calibration function (1) instead of (5). All errors are expressed in mDa, which roughly correspond to relative errors in ppm for mass values around 1000 Da. Each spectrum was obtained by accumulation of 10 single time domains. (Similar results have been obtained for single spectra, with only slightly larger absolute values of the mass errors due to the lower S/N). As discussed above, deviations from the common calibration function (1) are larger for spectra having smaller excitation radii. The modified calibration function (5) results in noticeably reduced mass errors. The observed improvement was greater when applied over a limited mass interval (e.g. 1300–1500 Da), in the central region of the mass spectra. The relative improvement resulting from the modified calibration function, shown in the column "$\epsilon_0/\epsilon$", is typically larger for spectra having lower excitation radius. This is consistent with the above considerations; because the space charge induced frequency shifts are expected to decrease with increasing cyclotron radius of the ion cloud. The specific relationship between frequency shift and radius is expected to depend on the details of the ion cloud's configuration, as considered in theoretical studies.

To test the assumption that the frequency shifts are related to peak intensities and not to the type of ion species, a sample in which $[M+Na]^+$ peaks dominated over the $[M+H]^+$ and $[M+K]^+$ peaks, was prepared as shown in FIG. 2*b*. The modified calibration function (5) applied to these spectra resulted in the similar mass accuracy improvement; see Table 1.

The calibration coefficients obtained for the modified calibration function (5) correspond qualitatively to the simple model advanced in the derivation of the modified calibration function. The A coefficient is positive and corresponds to the magnetic field of 11.5 T. Essentially the same value of A was obtained using the common calibration function (1). The B coefficient is always negative and the C coefficient is positive, as expected.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for improving the calibration of a Fourier transform ion cyclotron resonance mass spectrometer wherein the frequency spectrum of a sample has been measured and the frequency (f) and intensity (I) of at least three species having known mass to charge (m/z) ratios and one specie having an unknown (m/z) ratio have been identified, comprising the steps of:

a) using the known (m/z) ratios, frequencies, and intensities of the at least three species, calculating coefficients A, B, and C, wherein the mass to charge ratio of at least one of the three species $(m/z)_i$ is equal to $$\frac{A}{f_i}+\frac{B}{f_i^2}+\frac{C\cdot G(I_i)}{f_i^Q}$$

wherein $f_i$ is the detected frequency of the specie, $G(I_i)$ is a predetermined function of the intensity of the specie, and Q is a predetermined exponent, and b) using the calculated values for A, B, and C, calculating the mass to charge ratio of the unknown specie $(m/z)_{ii}$ as the sum of $$\frac{A}{f_{ii}}+\frac{B}{f_{ii}^2}+\frac{C\cdot G(I_{ii})}{f_{ii}^Q}$$

wherein $f_{ii}$ is the measured frequency of the unknown specie, and $(I_{ii})$ is the measured intensity of the unknown specie.

2. The method of claim 1 wherein the predetermined function $G(I_i)$ is selected from the group consisting of $G(I_i)=I_i^P$, wherein P is greater than 0 and less than or equal to 10 and $G(I_i)=\ln I_I$.

3. The method of claim 1 wherein the predetermined exponent Q is between 0 and 10.

4. The method of claim 1 wherein the coefficients A, B, and C are calculated using a method selected from the group consisting of a least squares fit and solving simultaneous equations.

5. The method of claim 1 wherein more than three species having known mass to charge (m/z) ratios are measured, and additional terms having the general form of $$\frac{S\cdot G(I_i)}{f_i^Q}$$

are calculated wherein a coefficient S is calculated for each term, and using the calculated values for A, B, C and S, calculating the mass to charge ratio of the unknown specie $(m/z)_{ii}$ as the sum of $$\frac{A}{f_{ii}}+\frac{B}{f_{ii}^2}+\frac{C\cdot G(I_{ii})}{f_{ii}^Q}+\frac{S\cdot G(I_{ii})}{f_{ii}^Q}$$

wherein $f_{ii}$ is the measured frequency of the unknown specie, and $(I_{ii})$ is the measured intensity of the unknown specie.

6. The method of claim 5 wherein the predetermined function $G(I_i)$ is a constant function across the terms and is selected from the group consisting of $G(I_i)=I_i^P$, wherein P is greater than 0 and less than or equal to 10 and $G(I_i)=\ln I_I$.

7. The method of claim 5 wherein the predetermined function $G(I_i)$ is a not constant function across the terms.

8. The method of claim 5 wherein the predetermined exponent Q is constant across the terms and is between 0 and 10.

9. The method of claim 5 wherein the predetermined exponent Q is not constant across the terms.

10. The method of claim 5 wherein the predetermined exponent Q is not constant across the terms and varies as a linear progression.

11. The method of claim 5 wherein the predetermined exponent Q is not constant across the terms and varies as a geometric progression.

12. The method of claim 5 wherein the coefficients A, B, and C are calculated using a method selected from the group consisting of a least squares fit and solving simultaneous equations.

13. The method of claim 5 wherein the term $G(I_i)$ is equal to $\ln I_i$, and the intensity $I_i$ includes an arbitrary scaling factor, which renders the function $$\frac{A}{f_{ii}}+\frac{B}{f_{ii}^2}+\frac{C\cdot G(I_{ii})}{f_{ii}^Q}+\frac{D}{f_{ii}^Q}$$

insensitive to any units of ion intensity in the term $I_i$, for Q not equal to 1 or 2.

14. A method for improving the calibration of a Fourier transform ion cyclotron resonance mass spectrometer wherein the frequency spectrum of a sample has been measured and the frequency (f) and intensity (I) of at least three species having known mass to charge (m/z) ratios and one specie having an unknown (m/z) ratio have been identified, comprising the steps of:

a) using the known (m/z) ratios, frequencies, and intensities of the at least three species, calculating coefficients A, B, and C, wherein the mass to charge ratio of a least one of the three species $(m/z)_i$ is equal to $$\frac{A}{f_i}+\frac{B}{f_i^2}+\frac{C\cdot(I_i)}{f_i^2}$$

wherein $f_i$ is the detected frequency of the specie, $I_i$ is the intensity of the specie, and b) using the calculated values for A, B, and C, calculating the mass to charge ratio of the unknown specie (m/z)as the sum of $_{ii}$ $$\frac{A}{f_{ii}}+\frac{B}{f_{ii}^2}+\frac{C\cdot(I_{ii})}{f_{ii}^2}$$

wherein $f_{ii}$ is the measured frequency of the unknown specie, and $(I_{ii})$ is the measured intensity of the unknown specie.

15. The method of claim 13 wherein the coefficients A, B, and C are calculated using a method selected from the group consisting of a least squares fit and solving simultaneous equations.

16. A method for improving the calibration of a Fourier transform ion cyclotron resonance mass spectrometer wherein the frequency spectrum of a sample has been measured and the frequency (f) and intensity (I) of at least three species having known mass to charge (m/z) ratios and one specie having an unknown (m/z) ratio have been identified, comprising the steps of:

a) using the known (m/z) ratios, frequencies, and intensities of the at least three species, calculating coefficients A, B, and C, wherein the mass to charge ratio of a least one of the three species $(m/z)_i$ is equal to $$\frac{A}{f_i}+\frac{B}{f_i^2}+\frac{C\cdot\ln(I_i)}{f_i^3}$$

wherein $f_i$ is the detected frequency of the specie, $I_i$ is the intensity of the specie, and b) using the calculated values for A, B, and C, calculating the mass to charge ratio of the unknown specie $(m/z)_{ii}$ as the sum of $$\frac{A}{f_{ii}}+\frac{B}{f_{ii}^2}+\frac{C\cdot\ln(I_{ii})}{f_{ii}^3}$$

wherein $f_{ii}$ is the measured frequency of the unknown specie, and $(I_{ii})$ is the measured intensity of the unknown specie.

17. The method of claim 16 wherein the coefficients A, B, and C are calculated using a method selected from the group consisting of a least squares fit and solving simultaneous equations.

* * * * *